United States Patent [19]

Mergel et al.

[11] Patent Number: 4,945,566

[45] Date of Patent: Jul. 31, 1990

[54] METHOD OF AND APPARATUS FOR DETERMINING START-POINT AND END-POINT OF ISOLATED UTTERANCES IN A SPEECH SIGNAL

[75] Inventors: Dieter Mergel; Hermann Ney, both of Hamburg; Horst H. Tomaschewski, Stuvenborn, all of Fed. Rep. of Germany

[73] Assignee: U.S. Philips Corporation, New York, N.Y.

[21] Appl. No.: 274,093

[22] Filed: Nov. 18, 1988

[30] Foreign Application Priority Data

Nov. 24, 1987 [DE] Fed. Rep. of Germany ..... 3739681

[51] Int. Cl.[5] ..... G10L 5/00

[52] U.S. Cl. ..... 381/41; 381/46

[58] Field of Search ..... 381/41, 46

[56] References Cited

U.S. PATENT DOCUMENTS 4,688,256 8/1987 Yasunaga ..... 381/46

4,700,394 10/1987 Selbach et al. ..... 381/46

4,821,325 4/1989 Martin et al. ..... 381/46

*Primary Examiner*—Emanuel S. Kemeny

*Attorney, Agent, or Firm*—Bernard Franzblau

[57] ABSTRACT

In a method of and an arrangment for determining the start-point and end-point of a word signal in a speech signal consisting of isolated utterances, three adjacent windows are determined at each new digital value for the last arrived stored digital values, in which the central window contains the actual word signal. The length of this central window is varied for each digital value between a minimum and a maximum value, and a threshold value is determined from the two adjacent windows and is subtracted from the energy contained in the central window. Thus, the method and the apparatus always takes the overall speech signal into account instead of individual isolated portions so that a reliable end-point determination then is possible.

14 Claims, 3 Drawing Sheets

METHOD OF AND APPARATUS FOR DETERMINING START-POINT AND END-POINT OF ISOLATED UTTERANCES IN A SPEECH SIGNAL

BACKGROUND OF THE INVENTION

This invention relates to a method of determining the start-point and end-point of a word signal corresponding to an isolated utterance in a speech signal by establishing an extreme value in a sequence of digital values derived from the speech signal, taking into account values surrounding the extreme value of the signal variation and a threshold value.

Methods of this type for the determination of the start-point and end-point in a speech signal are used more specifically when the speech signal is formed by isolated utterances or very short word groups and these utterances or word groups, respectively, should be recognized automatically. In almost all applications, the actual word signal in the speech signal is accompanied by interferences and noise and pauses and also by extraneous noise such as loud breathing. In order to provide the highest reliable recognition of the word or words in the speech signal, it is however important to start the identification accurately with the speech signal portion, which also represents the start of the word to be recognized.

Several methods of determining start and end-points are known already. ICASSP 84 Proceedings, 19 to 21 Mar. 1984, San Diego, California describes on pp. 18B.7.4 a method of detecting end-points in a speech signal, which operates with the autocorrelation matrix of the speech signal. To obtain such a matrix requires a significant computational cost and design effort, and the results are not satisfactory in all conditions. U.S. Pat. No. 4,821,325 (4/11/89) uses an end-point detector which subdivides the speech signal into overlapping blocks. These blocks are however fixed, independently of the variation of the speech signal, and the block having the maximum energy is determined and the preceding block having an energy level below a threshold value, which is located below the maximum energy to a predetermined extent. By means of further expensive steps a number of such maxima and their duration are established and energy maxima of a longer duration are calculated therefrom. Furthermore, a reliable end-point recognition then is difficult and unreliable when high-level interferences are superimposed on the speech signal.

SUMMARY OF THE INVENTION

An object of the invention therefore is to provide a method of the type defined in the opening paragraph, which provides a best possible reliable start and end-point determination, also for speech signals on which significant noise signals are superimposed.

According to the invention, this object is accomplished in that a plurality of previously, sequentially received digital values are assigned to three adjacent windows, the first window (end-window) including a predetermined first number of the digital values which arrived last, the second window (signal window) including a second number of digital values, said second number varying between a predetermined first value and a predetermined higher second value, and the third window (start-window) including a predetermined third number of digital values; for each new digital value a threshold value is formed from the digital values in the first window and, consecutively for each value of the second number, from the digital values of the third window, each digital value of the second window being decreased by that threshold value; the sum of the digital values thus decreased is compared for each of said second number to the highest previous sum and similarly produced and, depending on the result of this comparison, is stored together with positional data indicating the position of the second window in the sequence of digital values; the positional data stored last indicate the start-point and the end-point of the word signal.

Thus, the method does not use fixed threshold values or single absolute maxima, but quasi-different start and end-points in the speech signal are assumed and it is checked whether the energy of the speech signal contained therein is in that case higher than in the other assumed end-points, a threshold value being subtracted which is determined from the adjacent ranges on both sides of the assumed range of the word signal. Acting thus, no local but a global criterion on the overall speech signal is used, since only that speech signal that stands out to a maximum extent from its environment is evaluated as a word signal. As the minimum and maximum width of the second window, which also represents the word signal, is limited, an additional protection from interferences is formed and, in addition, there is the possibility of unambiguously separating a plurality of sequentially and isloated uttered words from each other. Establishing the start and end-point is effected continuously on arrival of the speech signal, so that for each end-point determination which, at least for the time being, is the optimum determination, the recognition of the speech signal can start, this recognition being interrupted when a more advantageous value for the end-points is detected, so that also a fast recognition is possible.

So as to increase the reliability still further and, for example, to prevent short unstressed regions within a word from already being recognized as an end-point, it is advantageous, in accordance with an implementation of the invention, that only those positional data which have remained unchanged for a predetermined number of consecutively arrived digital values are used as the start-point and end-point. Thus, it is checked whether an adequately long speech interval follows after the end-point.

The threshold value which is used in the determination of the end-points, should be based, to the best possible extent, on the noise signal, whose value is however not known without further measures. In accordance with the invention, this value can be obtained by considering a region before and after the assumed position of the word signal. This threshold value can be formed in a particularly simple manner in that the threshold value is formed from the sum of the digital values in the first and third windows and a correction value. Such a sum can be obtained in a very simple and fast manner.

A fixed value which, for example, takes a general quality of the speech signal into consideration can be chosen as the correction value. A further implementation of the invention, in which this correction value takes the variation of the speech signal into account, is characterized, in that for each new digital value, using the lowest value of the second number, the sum of the digital values of the second windows is formed and stored if a previously stored second window sum is smaller than the present sum and the sum of the digital values of the third window is formed and stored if a previously stored third window sum is larger than the present sum, and the correction value is formed from the difference between the two stored window sums. Acting thus, not only the regions outside the assumed end-points are dealt with, but also the speech signal between the end-points. It is more specifically advantageous for the correction value to be the difference between the two window sums, divided by a constant predetermined signal-to-noise ratio value. The predetermined signal-to-noise ratio value is then a measure of the average quality of the speech signal and is the lower the more the speech signal is disturbed, as is, for example, the case when speech is transmitted via telephone lines.

It can easily occur in practice that noise signals are superimposed on the speech signal, which are indeed of a short duration, but have a high amplitude. In order to increase the reliability of the end-point recognition in this case too, it is advantageous, in accordance with a further implementation of the invention, to use as the digital value the lowest of always a plurality of consecutive digitized sampling values of the speech signal. This measure provides a very active filter for the speech signal.

According to the invention, an arrangement for performing the method of the invention, having a first store for storing digital values derived from a speech signal, is characterized in that it comprises a second store for storing intermediate results, an arithmetic unit which receives the digital values from the first store and also the intermediate results from the second store and determines the energy in always one of the windows and also the further intermediate results, and a comparator for comparing intermediate results from the second store with the values produced by the arithmetic unit and for controlling the entry of the latter values into the second store; the arrangement also includes a control unit for addressing, in accordance with the steps of the method, the first and the second store and the arithmetic unit, and a counting device for counting the different second numbers of digital values in the second window and for applying an end-of-loop signal to the control unit after a predetermined number of different second numbers of values. The control unit may be a stored program-driven run-off control. A particularly simple apparatus is obtained when at least the arithmetic unit and the control unit are constituted by a microprocessor. This processor may optionally also take over the function of the comparator and the counting arrangement.

BRIEF DESCRIPTION OF THE DRAWING

Embodiments of the invention will now be described, by way of example, with reference to the accompanying drawing, wherein.

DESCRIPTION OF THE PREFERRED EMBODIMENTS

Figure 1A:
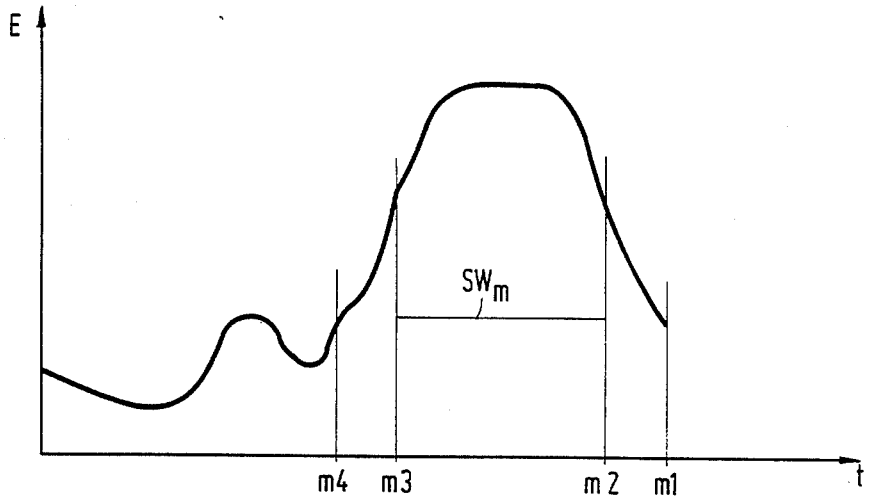
FIGS. 1*a* and 1*b* illustrate the different positions of the windows.

The signal variation is shown by way of example in FIG. 1*a* as the energy E or the amplitude of the speech signal as a function of time (t). The signal which arrived during a period of time t is sampled up to the instant m1 and is available in the form of digital sampling values. The signal variation which is shown as varying continuously is consequently available in the digital range as a sequence of discrete points, which however does not fundamentally affect the further description.

The signal variation is now divided into three-adjacent windows, the first window extending from the sampling values m1 to m2 and being denoted as the end-window, since, considered in time, it represents for the time being the end of the speech signal. The central window extends from the sampling value m2 to the sampling value m3. In this window the actual word signal is assumed to be present, and has a higher energy value than the speech signal portions preceding it and subsequent to it. For the method of end-point determination to be described, the point m3 is changed stepwise between a minimum distance and a maximum distance from the instant m2. The third window extends from the instant m3 to the instant m4, whose width is again constant.

It should be noted that each sampling value can only belong to one window, that is to say the central window starts, when the first window extends up to the sampling value at the instant m2, with the sampling value immediately to the left of it, and something similar also holds for the third window. For the sake of simplicity, this fact is not stressed further in the following description, but a quasi-continuous signal variation will be assumed hereinafter.

Figure 2A:
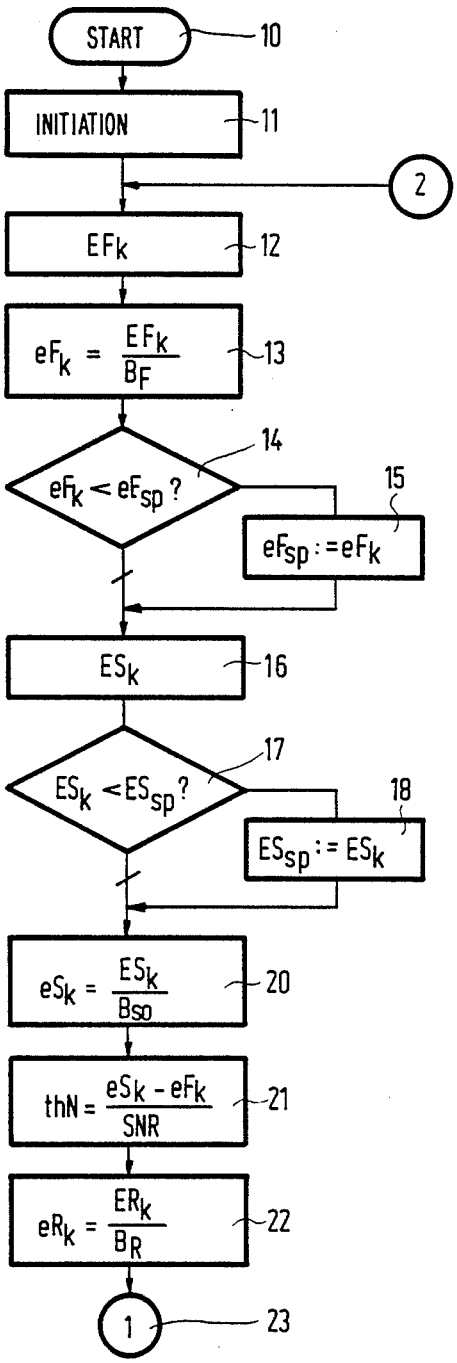
FIGS. 2*a* and 2*b* are flow charts for the run-off of the end-point determining method.
Figure 2B:
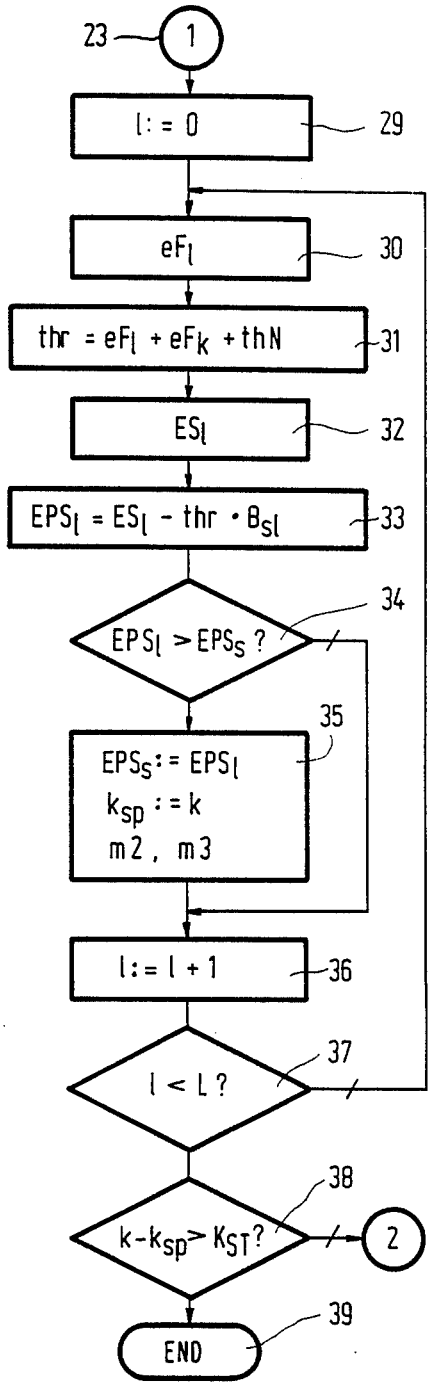

In FIG. 2*b* a later instant is assumed, at which the speech signal has already arrived up to the instant n1. In addition, the signal window is assumed to be larger, so that its start at the instant n3 is further remote from the instant n2 than in FIG. 1*a*. Consequently, the instant n4 which is the start of the initial window also is located at an even earlier instant.

A fundamental criterion in the determination of the end-points of the speech signal is the area occupied by the speech signal within the signal window, decreased by a threshold value SW, which inter alia depends on the area below the speech signal in the first and third windows. The areas below the speech signal are represented by the sum of the digitized sampling values within the specific window.

In FIG. 1*a* the area in the start window and stop-window is still relatively large, so that a higher threshold value $SW_m$ is obtained. It willbe immediately apparent from the Figure that the area reduced by the threshold value becomes larger in the central window when the start and end-windows are expanded, that is to say when the subsequently arriving portions of the signal variations are waited for and the width of the signal window is chosen to be greater.

Figure 1B:
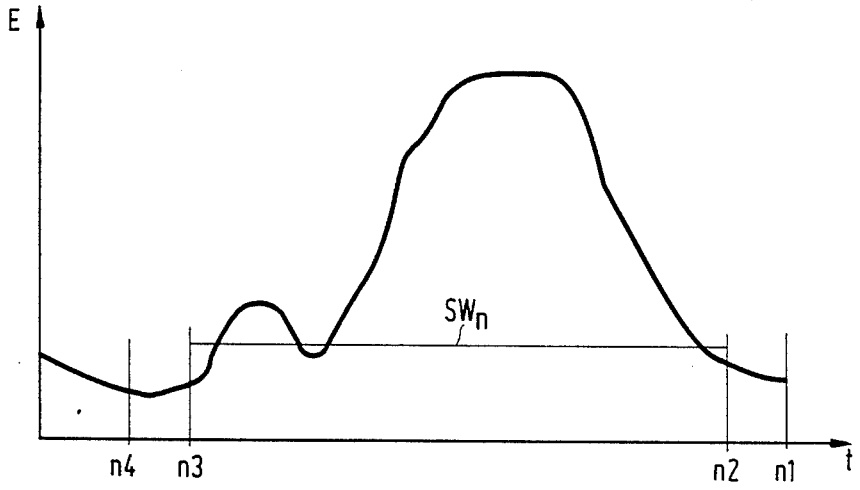

FIG. 1*b* shows the case in which the area below the speech signal in the start-window and in the end-window is now significantly smaller, so that also the threshold value $SW_n$ is at a lower value; however, it is now apparent that the portions of the speech signal nearest to the start and end-windows contribute negatively to the total area in the signal window less the threshold value $SW_n$, as these signal values are smaller than the threshold value. In the case of an optimum detection the start and end-points coincide with instants at which the signal value is equal to the threshold value. The range of the speech signal which, within these signal windows, is briefly below the threshold value $SW_n$, then does indeed contribute negatively, which however is exceeded by the higher signal section located to the left thereof, so that by extending the central window beyond this region of the speech signal an increase of the overall area in the singal window above the threshold value $SW_n$ is obtained. The start and end-points already mentioned in the foregoing are determined by the method illustrated in the flow chart of FIGS. 2*a* and 2*b*.

The symbol 10 denotes the start of the entire procedure, that is to say the start of the speech signal. In block 11 a plurality of start values are set, a number of sampling values in accordance with the length of the end-windows, of the minimum signal window and of the start-windows is awaited, before the method can start, and a special filter function can be effected. This filter function consists in that always the lowest value is chosen from three consecutive sampling values and is applied to the process as a digital value. Every 10 ms, for example, a sampling value is taken from the speech signal, which represents the instantaneous value or the integrated value since the previous, last sampling value, and the sampling values are digitized. When always the smallest value is chosen from three consecutive sampling values, the procedure consequently receives a digital value every 30 ms, so that 30 ms is available to effect the subsequent steps of the procedure. The applied digital values are stored, as they are required at later instants, and, more specifically, at least once every signal period, which corresponds to the sum of the preset maximum duration of the signal windows and the two other windows.

In block 12 the energy $EF_k$ in the start-window is determined between the instants m3 and m4 in FIG. 1*a* and m3 and m4, respectively, in FIG. 1*b* by adding together the signal values contained therein. In the block 13 this value is divided by the length $B_F$ of the start-window and thus the average energy $eF_k$ in this window is determined.

A comparator 14 checks whether this average value $eF_k$ is less than a stored value $eF_{sp}$, and, if so, this lower value is stored in block 15, i.e. $eF_{sp}$ is replaced by the instantaneous value $eF_k$. After the block 15 or when the new value in block 14 is not less than the stored value, the energy $ES_k$ of the signal window having the minimum length is determined in block 16, and also the areas below the speech signal variation between the instants m2 and m3 in FIG. 1*a*, for which the stored digital values are also added together in this region. Thereafter, in a box 17 a comparator checks whether this energy $ES_k$ exceeds a stored energy $ES_{sp}$. If yes, the stored value is replaced in block 18 by the new value, and subsequent thereto or when the new value does not exceed the stored value, the average energy $ES_k$ is determined in block 20, by dividing the total energy $es_k$ by the minimum width $B_{s0}$ of the signal window. The width B of this window and also of the further windows is always denoted by the number of digital values present therein.

Thereafter a correction value thN is determined in block 21 from the difference between the average energy $eS_k$ in the signal window and $eF_k$ in the start-window, which is divided by an assumed signal-to-noise ratio value SNR. Finally, in block 22 the average energy in the end-window, so between the instants m1 and m2 in FIG. 1*a* or n1 and n2 in FIG. 1*b*, is determined in a similar manner to that for start-window.

The steps 12 to 22 are performed only once for each newly arrived digital value, while the junction point 23 now leads to a loop which for each allowed width of the signal window is passed through once. These single cycles are indicated by the index 1.

This loop, which starts with the junction point 23 is illustrated in FIG. 2*b*. In block 29 this value 1 is set at the start value zero. In the subsequent block 30 the average energy value $eF_1$ of the start-window is determined at each instantaneous shift 1 from the minimal width of the signal window, in accordance with block 13, and in the block 31 the value thus obtained is added to the average energy value of the start-window obtained in block 22 and to the correction value thN obtained in block 21, to produce the threshold value thr. Thereafter in block 32, the energy $ES_1$ of the signal window is determined for the current width by adding together the digital values in this window. Finally, in block 33 the threshold value thr, multiplied by the current width $B_{S1}$ of the signal window, is subtracted from the energy value $ES_1$. This is the area below the signal variation in FIG. 1*a* between the instants m2 and m3 or in FIG. 1*b* between the points n2 and n3, respectively, decreased by the area below the threshold value $SW_m$ or $SW_n$, respectively, between these points. This effective energy $EPS_1$ is considered to be the energy of the speech signal in the signal window, which by far exceeds the noise signal. It is not possible to directly obtain this noise signal without a probable value in the form of the threshold value being derived in the manner described in the foregoing.

The comparator 34 checks whether this last obtained effective energy $EPS_1$ of the speech signal exceeds a stored value $EPS_S$. If yes, this new value is stored in block 35. In addition, it is stored at which last arrived digital value this has been effected, by storing an instantaneous index k as a value $k_{sp}$, and in addition start and end-points of the signal windows, that is to say the values m2 and m3 in FIG. 1*a* or n2 and n3 in FIG. 1*b*, respectively, are stored. Subsequent thereto, or, when in the comparison effected in comparator 34 the new value does not exceed the stored value, the loop value 1 is increased in block 36 by and in comparator 37 it is checked whether this value 1 has reached the predetermined maximum value L in accordance with the maximum width of the signal window. Should this not be the case, a return is made to the block 30.

In the other case i.e. when 1=L, the comparator 38, then checks whether the detected maximum of the energy in the speech window is stationary, that is to say whether an adequate number $K_{ST}$ of further digital values has been applied, without a higher energy value having been found. If not, the procedure returns to block 12 and the subsequent digital value is processed. When, however, during a predetermined number of newly applied digital values, no higher eneergy has been found in the signal window, it is assumed that the effective energy last stored in the block 35 designates that signal window that corresponds to the best possible extent to the word signal within the speech signal, and the then stored positional values of the windows, that is to say the points m2 and m3 or n2 and n3, respectively, indicate the target start and end-point of the word signal.

The flow diagram in FIGS. 2*a* and 2*b* contain only the most essential process steps. It is more particularly possible to omit some arithmetic steps in the performance of the method when intermediate values are stored. For example, the energy values $EF_k$ or the corresponding average energy values, respectively, obtained in the respective blocks 12 and 13, can always be intermediately stored, as they can again be used in the subsequent applied digital values, since the start-window or the smallest width of the signal window for a predetermined digital value has the same position as the start-window at the subsequent digital value, when the signal value is incremented by one unit with respect to the minimum value, etc. This also holds for the energy in the signal window. This saving in computing time requires however a greater storage and address control cost and design effort for the intermediate store.

When the described method is used in combination with an automatic speech recognition method, the recognition procedure can start each time that the values in the block 35 are stored again, so that then, when finally the stationary state has been detected in the block 38, the recognition method can already be in a much further stage, so that in this manner a fast recognition, optionally a real time recognition, is possible.

Figure 3:
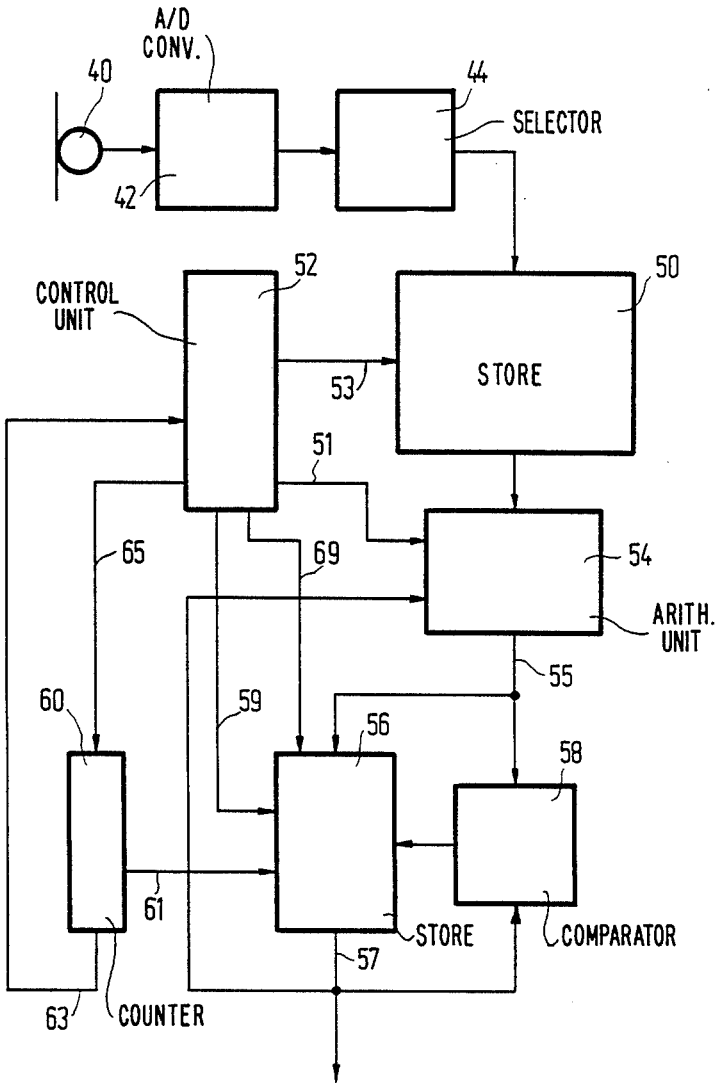
FIG. 3 shows schematically a block circuit diagram of an arrangement for performing the method.

In the arrangement as shown in FIG. 3 a transducer 40 picks up a speech signal and converts it into an electrical signal. This electrical signal is applied to a unit 42 which at regular time intervals takes the continuous signal and digitizes it. The unit 44 selects the lowest of always three consecutive digitized sampling values and applies the digital values thus obtained to a store 50. When the unit 42 takes the speech signal from a sampling value every 10 ms, the store 50 consequently receives a new digital value every 30 ms. This new digital value is stored in an address supplied by a control unit 52 via the connection 53.

The control unit 52 is preferably a microprocessor such as the SC 68000 by Signetics Corp., which may be programmed to perform the steps indicated in FIGS. *2a* and *2b*.

In a corresponding manner the control unit also addresses the store 50 to read the stored digital values, which are applied to an arithmetic unit 54. This arithmetic unit 54 may be a conventional arithmetic logic unit such as the SN 74181 combined with an accumulation register both controlled by the control unit 52 via a connection 51, or it may be a part of the control unit 52. The arithmetic unit performs the arithmetic steps shown in the flow diagram in FIGS. *2a* and *2b* by means of the blocks 12, 13, 16, 20 to 22 and 30 to 33. The arithmetic unit 54 more specifically determines the energy in the start-window by adding together the corresponding digital values addressed by the control unit in the store 50 and forms the average energy. This average energy is applied to a comparator 58 via the line 55. The comparator receives at its other input the corresponding previously stored value from a second store 56 via its data output line 57. The second store 56 is then also addressed by the control unit 52 via the line 59. When the newly obtained value available on the line 55 is less than the available stored value on the line 57, the comparator 58 produces a corresponding signal and applies it to the second store 56, so that now the new value available on the line 55 is stored in the addressed location. This corresponds to the blocks 14 and 17 in FIG. *2a*. In a similar manner, the other calculations and comparisons also are effected, the arithmetic unit 54 receiving more specifically in the steps 21, 31 and 33 the values required there, from the second store 56 via the line 57. To store the further values in the step 35, the control unit 52 applies these values to the data input of the second store 56 via the line 69.

In addition, a counter 60 is present which counts the index 1. Via the line 65 the counter 60 is reset to the initial position by the control unit 52 and is supplied with counting pulses, as is indicated at the steps 29 and 36 in FIG. *2b*. Each time the counter 60 has received a number L of clock signals, which corresponds to the difference between the lowest and the highest signal value, it applies an end-of-loop signal to the control unit 52 via the line 63. This corresponds to the comparison 37 in FIG. *2b*. The comparison 38 is suitably effected in the control unit 52.

A simple implementation of the arrangement of FIG. 3 occurs when the control unit 52 and the arithmetical unit 54 are constituted by a microprocessor. This microprocessor can then perform the functions of the comparator 58 and the counter 60, so that a very simple apparatus is obtained.

What is claimed is:

1. In a method of determining a start-point and an end-point of a word signal corresponding to an isolated utterance in a speech signal by establishing an extreme value in a sequence of digital values derived from the speech signal, taking into account those values surrounding the extreme value of the signal variation and a threshold value, the improvement comprising: assigning a plurality of previously, sequentially received digital values to three adjacent time windows, a first window (end-window) including a predetermined first number ($B_R$) of the digital values which arrived last, a second window (signal window) including a second number ($B_{S1}$) of digital values, said second number varying between a predetermined first value and a predetermined higher second value, and a third window (start-window) including a predetermined third number ($B_F$) of digital values, forming for each new digital value a threshold value (thr) from the digital values in the first window and, consecutively for each value (1) of the second number ($B_{S1}$), from the digital values of the third window, decreasing each digital value of the second window by said threshold value, comparing the sum of the digital values thus decreased for each of said second number to the highest previous sum similarly produced and, depending on the result of said comparison, storing said sum together with positional data indicating the position of the second window in the sequence of digital values, and wherein the positional data stored last indicate the start-point and the end-point of the word signal.

2. A method as claimed in claim 1, wherein only positional data which remained unchanged for a predetermined number of consecutively arrived digital values are used as start-point and end-point.

3. A method as claimed in claim 2, wherein the threshold value is formed by adding the digital values in the first window and in the third window and a correction value.

4. A method as claimed in claim 3, wherein for each new digital value, using the lowest value of the second number ($B_{S0}$), the sum of the digital values of the second window is formed and stored if a previously stored second window sum is smaller than the present sum and the sum of the digital values of the third window is formed and stored if a previously stored third window sum is larger than the present sum, and the correction value is produced by taking the difference between the two stored window sums.

5. A method as claimed in claim 4, wherein the correction value is the difference between the two window sums, divided by a constant predetermined signal-to-noise ratio value.

6. A method as claimed in claim 1, wherein the lowest of always three consecutive digitized sampling values of the speech signal is used as the digital value.

7. An arrangement for performing the method as claimed in claim 1 comprising: a first store for storing digital values derived from a speech signal, a second store for storing intermediate results, an arithmetic unit which receives the digital values from the first store and also the intermediate results from the second store and determines the energy in one of the windows and also further intermediate results, a comparator for comparing intermediate results from the second store to the values produced by the arithmetic unit and for controlling entry of the arithmetic unit values into the second store, a control unit for addressing, in accordance with the steps of the method, the first and the second store and the arithmetic unit, and a counting device for counting the different second numbers of digital values in the second window and for applying an end-of-loop signal to the control unit after a predetermined number of different second numbers of values.

8. An arrangement as claimed in claim 7, wherein at least the arithmetic unit and the control unit comprise a microprocessor.

9. A method as claimed in claim 1, wherein the threshold value is formed by adding the digital values in the first window and in the third window and a correction value.

10. A method as claimed in claim 9, wherein for each new digital value, using the lowest value of the second number ($B_{S0}$), the sum of the digital values of the second window is formed and stored if a previously stored second window sum is smaller than the present sum and the sum of the digital values of the third window is formed and stored if a previously stored third window sum is larger than the present sum, and the correction value is produced by finding the difference between the two stored window sums.

11. A method as claimed in claim 10, wherein the correction value is determined by taking the difference between the two window sums, divided by a constant predetermined signal-to-noise ratio value.

12. A method as claimed in claim 1, wherein the threshold value is determined by:

deriving a first signal indicative of average energy in the first window, deriving a second signal indicative of average energy in the third window, deriving a third signal indicative of a threshold correction value, and adding said first, second and third signals to derive a further signal indicative of said threshold value.

13. A method as claimed in claim 12, wherein said third signal is derived by:

deriving a fourth signal indicative of average energy in the second window, subtracting said second signal from the fourth signal, and dividing the result of the subtracting step by a given signal/noise ratio value to derive said third signal.

14. A method as claimed in claim 9, wherein the digital value comprises a lowest value of three consecutive digitized sampling values of the speech signal.

* * * * *